US006588424B2

(12) United States Patent
Bardel

(10) Patent No.: US 6,588,424 B2
(45) Date of Patent: Jul. 8, 2003

(54) PROTECTIVE EQUIPMENT WITH FAST FIXING HEAD

(75) Inventor: Michel Bardel, Plaisir Cedex (FR)

(73) Assignee: Intertechnique, Plaisir Cedex (FR)

( * ) Notice: Subject to any disclaimer, the term of this patent is extended or adjusted under 35 U.S.C. 154(b) by 0 days.

(21) Appl. No.: 09/959,878

(22) PCT Filed: Mar. 6, 2001

(86) PCT No.: PCT/FR01/00659

§ 371 (c)(1),
(2), (4) Date: Nov. 9, 2001

(87) PCT Pub. No.: WO01/68187

PCT Pub. Date: Sep. 20, 2001

(65) Prior Publication Data

US 2002/0157668 A1 Oct. 31, 2002

(30) Foreign Application Priority Data

Mar. 10, 2000 (FR) ..... 00 03110

(51) Int. Cl.[7] ..... A62B 18/08

(52) U.S. Cl. ..... 128/207.11; 128/206.21; 128/206.27; 128/206.23

(58) Field of Search ..... 128/206.27, 207.11, 128/201.19, 201.22, 201.29, 206.23, 206.21, 206.24, 206.25, 206.28, 206.26

(56) References Cited

U.S. PATENT DOCUMENTS 3,599,636 A * 8/1971 Gutman et al. ..... 128/207.11
4,437,462 A * 3/1984 Piljay et al. ..... 128/207.11
4,870,959 A * 10/1989 Reisman et al. ..... 128/201.22
4,915,106 A * 4/1990 Aulgur et al. ..... 128/205.24
5,036,846 A * 8/1991 Aulgur et al. ..... 128/205.24
5,431,156 A * 7/1995 Sundstrom ..... 128/201.23
5,488,948 A * 2/1996 Dubruille et al. ..... 128/206.21
5,503,147 A * 4/1996 Bertheau ..... 128/201.22
5,623,923 A * 4/1997 Bertheau et al. ..... 128/201.22
5,630,412 A * 5/1997 Dubruille et al. ..... 128/201.22
5,664,566 A * 9/1997 McDonald et al. .... 128/205.25
5,690,102 A * 11/1997 Bertheau et al. ..... 128/205.24
5,770,886 A * 6/1998 Rao et al. ..... 257/476
5,941,245 A * 8/1999 Hannah et al. ..... 128/201.22
5,957,132 A * 9/1999 McDonald et al. .... 128/206.21
6,039,045 A * 3/2000 Bertheau et al. ..... 128/206.27
6,070,580 A * 6/2000 McDonald et al. .... 128/206.21
6,328,031 B1 * 12/2001 Tischer et al. ..... 128/201.22
6,443,155 B1 * 9/2002 McDonald et al. .... 128/206.21

* cited by examiner

*Primary Examiner*—Glenn K. Dawson
*Assistant Examiner*—Michael G. Mendoza
(74) *Attorney, Agent, or Firm*—Larson & Taylor PLC

(57) ABSTRACT

The invention concerns a protective breathing equipment comprising a respirator provided with a regulator designed to be connected to a source of breathing mixture under pressure and a harness having at least an extensible strap whereof the ends are connected to the respirator and comprising an element temporarily inflatable with the pressurised breathing mixture to extend the strap until it reaches a sufficient dimension to enable the user to engage the harness on his head and capable of being emptied to enable the strap, to press the respirator against his face. A flexible envelope covering the head is tightly fixed to the single strap or to the upper strap of the harness and fixed to the respirator; it is transparent at least in the portion opposite the eyes when the equipment is worn.

13 Claims, 4 Drawing Sheets

PROTECTIVE EQUIPMENT WITH FAST FIXING HEAD

BACKGROUND OF THE INVENTION

The invention relates to a head protection equipment comprising a breathing mask, a harness enabling it to be put into place quickly on the face, and means for providing the eyes with protection against smoke.

Protective equipment that can be donned quickly is already known (EP-A-0 288 391 or U.S. Pat. No. 5,690,102), and it is intended in particular for the flight crew of passenger-carrying aircraft, the equipment being of the breathing mask type provided with a regulator for connection to a source of breathing gas under pressure (generally oxygen) together with a harness having at least one extensible strap whose ends are connected to the mask and which includes an element that can be inflated temporarily by the gas under pressure in order to lengthen the strap to a size that is large enough to enable the user to put the harness over the head, and that can then be exhausted to allow the strap to tighten, to press the mask against the face, and to hold it in place. The equipment described by way of example in U.S. Pat. No. 5,690,102 enables the pressure in the inflatable element to be adjusted in such a manner as to give it an intermediate value between the full emptying pressure and the full inflation pressure, thereby making it possible to reduce the discomfort caused by wearing the mask continuously under flight conditions where that is essential. In the equipment according to U.S. patent application Ser. No. 09/700117 (published as U.S. Pat. No. 6,470,887 B1), mechanical adjustment is substituted for pressure adjustment. Documents EP-A-0 628 325 (or U.S. Pat. No. 5,503,147) and U.S. Pat. No. 5,623,923 provide for automatic adjustment. In order also to provide the eyes with protection against aggressive agents, and in particular smoke, and without using a hood with a neck gasket, proposals have been made to fit the above-defined equipment with a transparent visor that is ventilated internally from a breathing regulator. The visor can be permanently fixed to the mask as in the equipment sold under the trademark "MAGIC" by the assignee of the present invention (U.S. design Pat. No. 304 384) or it can be detachable so as to make the mask easier to store (U.S. Pat. No. 5,630,412). In both cases, orifices for delivering breathing gas under pressure from the regulator to the visor are provided to sweep over the visor and avoid it misting up.

Another solution for facilitating storage consists in using a visor that is flexible and foldable. Equipment with visors of that kind, for use by the US Air Force, has been marketed since 1976 by Scott Aviation under the reference MBU-2/P. That equipment comprises a nose-and-mouth mask sealed to a flexible transparent visor of polyurethane and provided with a leaktight gasket bearing against the face. Because of the presence of a face gasket, it is difficult and awkward to fold the equipment for stowage in a box; long-duration storage can damage the gasket.

BRIEF SUMMARY OF THE INVENTION

The present invention seeks in particular to provide head protection equipment that surrounds the eyes and the openings of the airways, providing comfort that is equivalent to that of existing equipment, that is easily stored, and that provides sufficient protection against smoke and gases that irritate the eyes. For this purpose, the invention makes use of the fact that total gas-tightness is not necessary, since ventilation due to the breathing gas being under pressure suffices to expel smoke and irritant gases.

Consequently, the invention proposes equipment of the kind defined above, characterized by a flexible cover covering the head, fixed in leaktight manner to a sheath for limiting elongation of the single strap, or of the top strap of the harness, and fixed to the mask, said cover being transparent, at least in a portion thereof that lies in front of the eyes when the equipment is being worn.

This structure makes it possible to avoid fitting the cover with a visor face gasket of the kind that is essential in prior equipment, where such a gasket is too stiff to make it convenient to fold the equipment properly for storage purposes.

The connection between the cover on the one hand, and the mask with the strap on the other can be made completely gastight; there generally remains a gap between the face and the cover in a boundary zone behind the sealing gasket of the mask. However this gap can be made very small by disposing the straps appropriately, as explained below. Under such circumstances, pressurized breathing gas coming from the regulator via the mask leaks into the environment sufficiently to expel any smoke or irritant gases tending to penetrate towards the eyes.

The leaktight or substantially leaktight connection between the cover and the extensible strap can be provided by winding the edge of the cover around the inextensible outer sheath that is commonly provided for limiting elongation of the strap. This connection between the cover and the inextensible sheath of the strap can be provided by stitching or by adhesive, in particular.

The edge of the cover need to be long enough to avoid impeding lengthening of the strap for the purpose of donning the equipment. This edge then puckers when the strap deflates. Experience shows that shrinkage of the strap during deflation occurs for the most part in its rear portion, and thus without provoking puckering that affects the visor. It is often advantageous for the portion of the cover that is close to the mask to be made stiffer than the rear portion of the cover so as to ensure that the front portion does not pucker.

In a modified embodiment, the cover is not restricted to being a mere cap. It is extended downwards from the single strap or from the top strap in order to provide additional protection. For harness having two straps, the tubular portion of the cover beneath the top strap can be free relative to the bottom strap or it can be fixed to the sheath of the strap. In the first case it suffices for the cover to pass outside the bottom strap so that when the bottom strap inflates it spreads out the bottom portion and makes the equipment easier to put onto the head. In contrast, when it is desired for protection to be as complete as possible, it is advantageous to place the bottom portion of the cover inside the bottom strap.

The cover can be implemented in various ways, in particular as a function of the user for whom the equipment is intended and as a function of the optical quality required for the transparent portion.

In a particularly simple solution, the cover is a single piece of transparent material such as polyurethane, with a portion thereof constituting a visor. To prevent the visor-forming zone from kinking, this zone can be made thicker so as to be less flexible than the remainder of the cover.

The visor can be a single piece, or it can comprise separate eyepieces united by a thinner portion that makes folding easier for storage purposes.

Having the cover structured in this way to form a head-covering cap, has the advantage of being particularly simple and of providing a very wide field of view. The optical qualities that can be obtained are generally insufficient for a pilot. However, this solution can be adopted for other crew members of civilian or military aircraft when a small loss of precision in vision can be accepted, and this also applies for applications on the ground.

In another embodiment, the cover is of composite structure. The non-transparent portion is of a flexible fabric that is impermeable or of very low permeability, that is preferably not flammable, and that withstands high temperatures. In particular, it is possible to use the fabric sold under the trademark NOMEX, which fabric is coated to make it better proof against contaminants. The transparent portion is constituted by a flexible visor comprising a single piece or two eyepieces, made of polyurethane or some other material which can either be rigid when high optical quality is required, or else slightly flexible, and in either case the visor is fixed in leaktight manner to the fabric.

This embodiment presents the additional advantage in that the cover constitutes a cap that protects the scalp against high temperatures and possibly also protects the neck, and indeed the shoulders, when the cover has a bottom portion extending beneath the top strap.

In a modified embodiment the usual box for storing the head protection equipment is replaced by a flexible bag which can be designed to receive equally well a mask with a pneumatic harness enabling it to be donned quickly or a mask including a cover for protection against smoke.

The above characteristics and others will appear more completely on reading the following description of particular embodiments given as non-limiting examples.

BRIEF DESCRIPTION OF THE INVENTION

Figure 1:
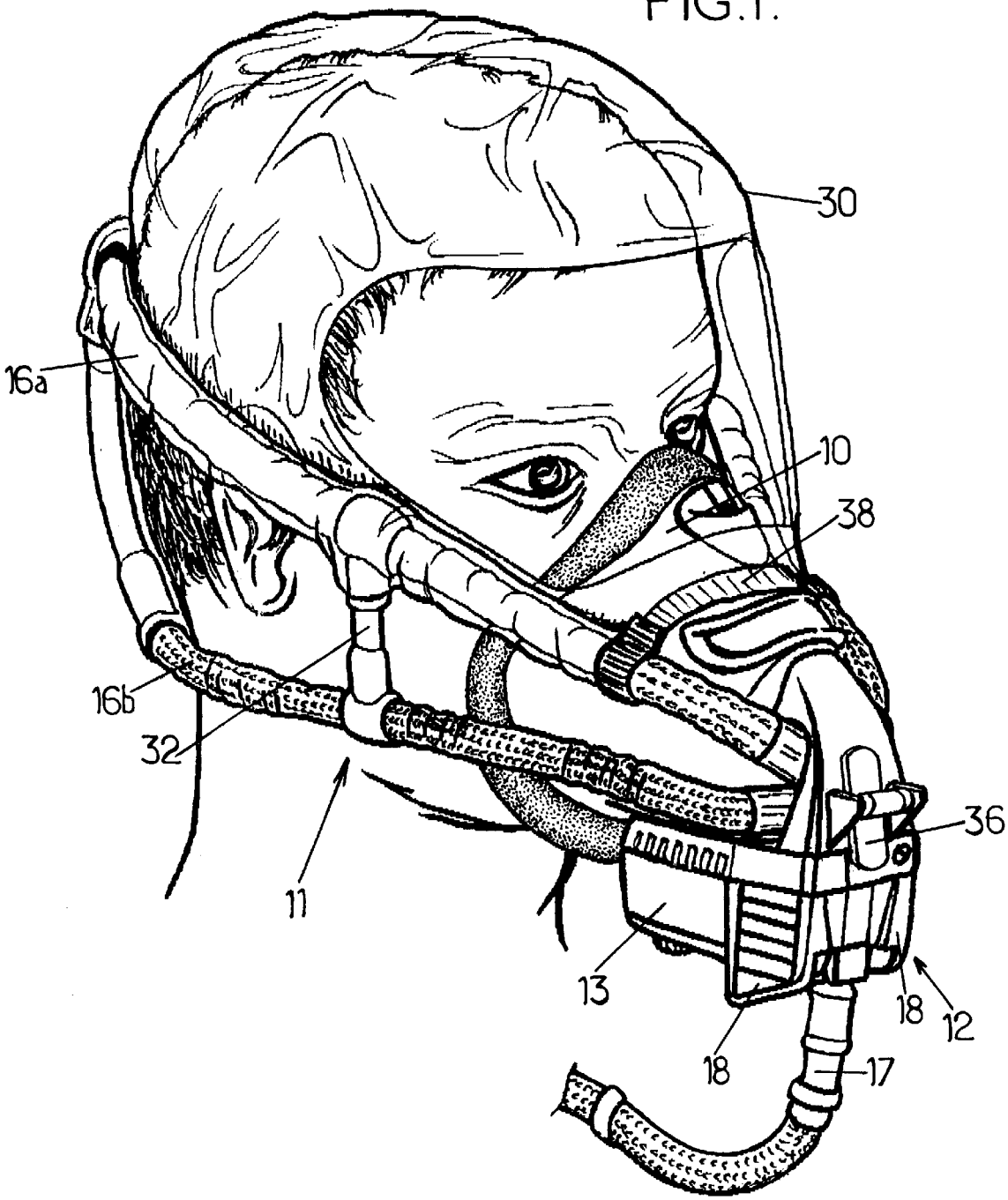
FIG. 1 is a perspective view showing the outside appearance of an embodiment of protection equipment of the invention, in place on the head.
Figure 2:
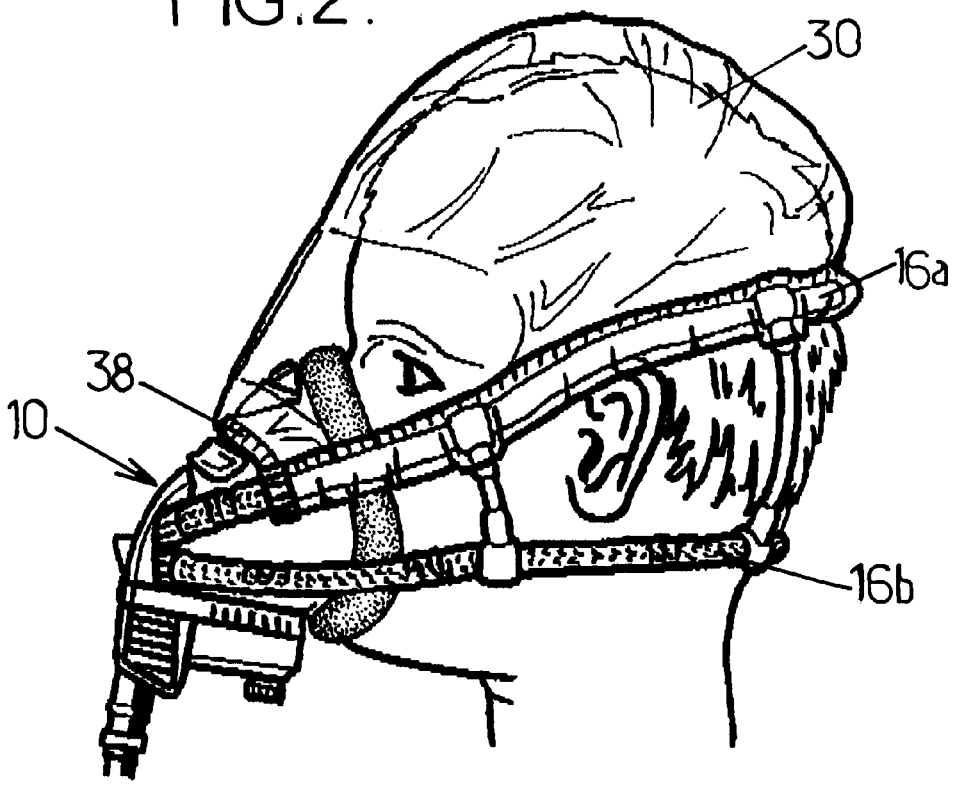
FIG. 2 is a diagrammatic elevation of the FIG. 1 equipment.

FIG. 1 shows emergency breathing equipment in its state when the harness is in place on the head. The equipment can be considered as comprising a mask 10 and a harness 11. The mask shown has a face mask covering the nose and the mouth and provided at the rear with a gasket for providing sealing against the face, which gasket can be constituted by a thin inwardly-directed fold. The face mask is secured to a demand regulator 13 and to a rigid connection block 12. The connection block is provided with a coupling connecting it to a flexible hose 17 for connection to a source of breathing gas under pressure (generally oxygen). The harness shown comprises two straps 16*a* and 16*b* each constituted by an inner tube of a material that enables the tube to lengthen and that is contained inside a substantially inextensible sheath that limits the extent to which the tube can lengthen. In the intended application, the regulator 13 can operate with or without dilution using air taken from the cabin, possibly with pressurization, and it can operate with a non-diluted breathing gas feed in the event of decompression taking place at high altitude and/or in the presence of smoke.

The regulator is connected to the feed hose 17 via the connection block 12. The block includes means for manually controlling inflation of the straps 16, e.g. constituted by a cock designed to be actuated by manually pinching together two lugs 18 carried by the connection block 12, with one of the lugs being pivotally-mounted.

The cock is designed in such a manner that when it is left free it puts the inside volume of the connection block 12 and the straps 16 into communication with the atmosphere, thus enabling the straps to shrink and press the mask against the face. When the cock is actuated, it acts on the contrary to admit gas under pressure from the feed hose 17 into the inside volume, thereby causing the straps to lengthen sufficiently to enable the mask to be donned quickly.

The regulator can include an aneroid capsule constituting an altitude detector and serving to put the straps automatically in connection with the surroundings in order to generate maximum tightness in the event of local depressurization.

The disposition described above is known. It can be associated with manual control means 36 (U.S. Pat. No. 5,690,102) or automatic control means (U.S. Pat. No. 5,503,147) for adjusting the residual pressure in the straps so as to reduce the discomfort of wearing the mask continuously. Another solution consists in causing at least one of the branches of the harness to be connected to the demand regulator via a member for mechanically adjusting length (French patent application FR 98/05949). The present invention is applicable to all those circumstances.

In the embodiment of the invention shown in FIG. 1, the equipment also comprises a cap-forming cover 30, made of a material that is transparent and flexible, e.g. polyurethane, polyethylene, or Kapton, with the edge of the material passing under the top strap 16*a*, being folded around it, and being connected in leaktight manner to the sheath for limiting extension of the strap. Notches provided in the edge serve to pass flexible strips 32 which interconnect the two straps at intervals. The connection with the mask can be made leaktight merely by sticking down a laterally-extending folded-over strip 38 of the cover, thereby tending to hold the portion of the cap that constitutes the visor in a position that is far enough away from the face. This visor-forming portion and the zone connecting to the stuck-down strip can be preshaped so as to be thicker than the remainder of the cap in order to ensure that the visor takes up a well-determined shape when the equipment is in place on the head. The inside of the visor is ventilated by supplying air from the regulator through passages that are not shown, but which can be similar to those of the MAGIC mask described in U.S. design Pat. No. 304 384 or in U.S. Pat. No. 5,630,412.

Figure 3:
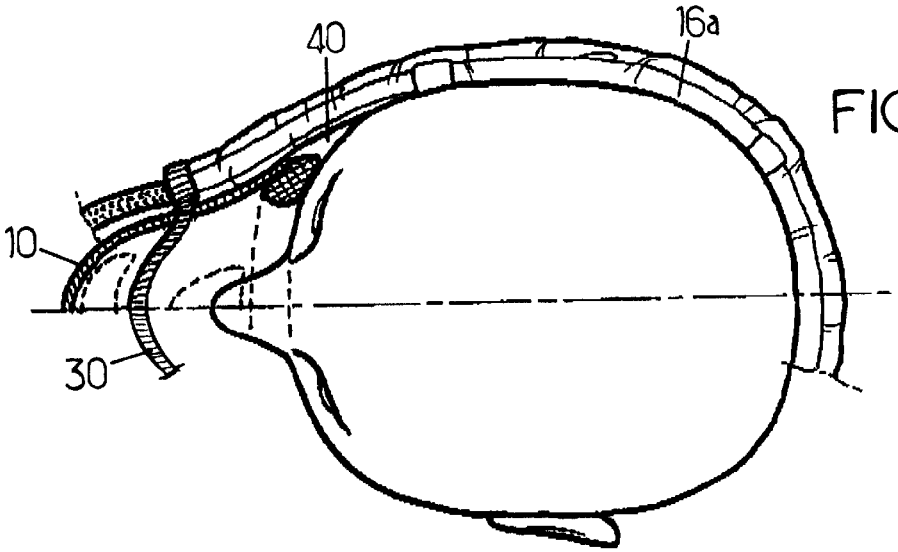
FIG. 3 is a diagrammatic horizontal section on a larger scale showing the junctions between the components of the FIG. 1 equipment and how they press against the head.

As shown in FIG. 3, it is difficult to avoid leaving a gap 40 along the face between the sealing gasket and the folded-in edge of the mask on the one hand and the face and indeed the cap on the other. However, this gap can be of very small right section if the straps are connected to the mask in front of the gap, as shown in FIG. 1. The gap can be closed by a flexible tongue fixed to the mask, or by a bib. The breathing gas under pressure coming from each inside the cover and escaping to the outside prevents ingress of polluting gas coming from the surroundings.

Figure 4:
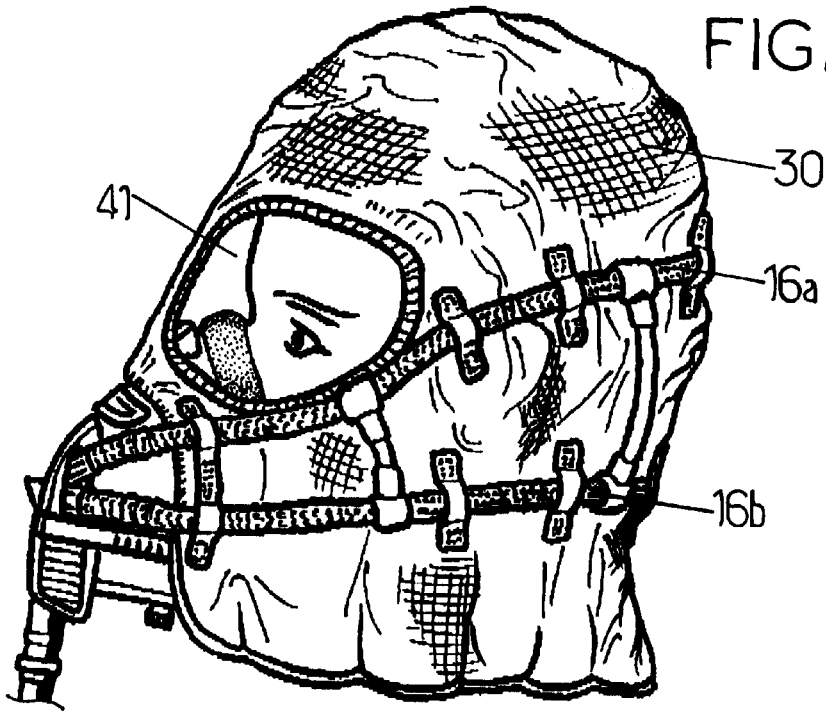
FIG. 4 is an elevation view showing another embodiment.

In the variant embodiment shown in FIG. 4, the cover 30 is extended downwards below the strap. It passes beneath both straps and it is stuck at least to the top strap. If it is also stuck to the bottom strap, then the bottom strap, on inflating, causes the bottom portion of the cover to expand, thus making it easier to put into place on the head.

Figure 5:
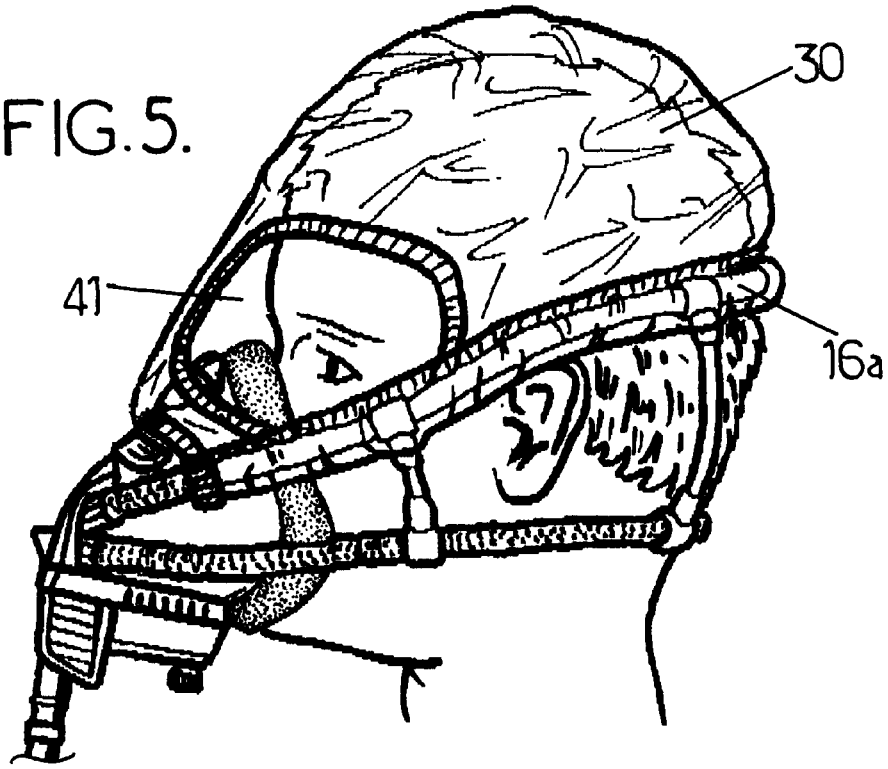
FIGS. 5 and 6 are similar to FIG. 4 and show variant embodiments.

The equipment in the embodiment shown in FIG. 5 differs from that of FIG. 1 in that the cover is of composite structure. The major portion of the cover 30 and in particular the portion which is fixed to the sheath of the top strap 16*a* is made of a fabric or of a film of a material that can be opaque, flexible, connectable in leaktight manner to the sheath of the strap, and advantageously presenting good ability to withstand high temperatures. In particular, it is possible to use fabrics presenting elasticity and/or flexibility that facilitate the deformation required by the connection to the sheath which passes in use between a puckered state and a tensioned state. In particular, it is possible to use NOMEX which is frequently used to make the sheaths of straps.

Where it faces the eyes, the cover has a transparent portion 41 constituting a common eyepiece or two separate eyepieces and sufficiently flexible to be suitable for storage in a conventional box on a transport airplane, while also being capable of taking up a well-determined shape when no longer stressed, so as to ensure that it has good optical qualities. The cover is of a shape such that the eyepiece occupies a position in the immediate vicinity of the eyes when the strap is retracted, so as to avoid excessively diminishing peripheral vision.

Figure 6:
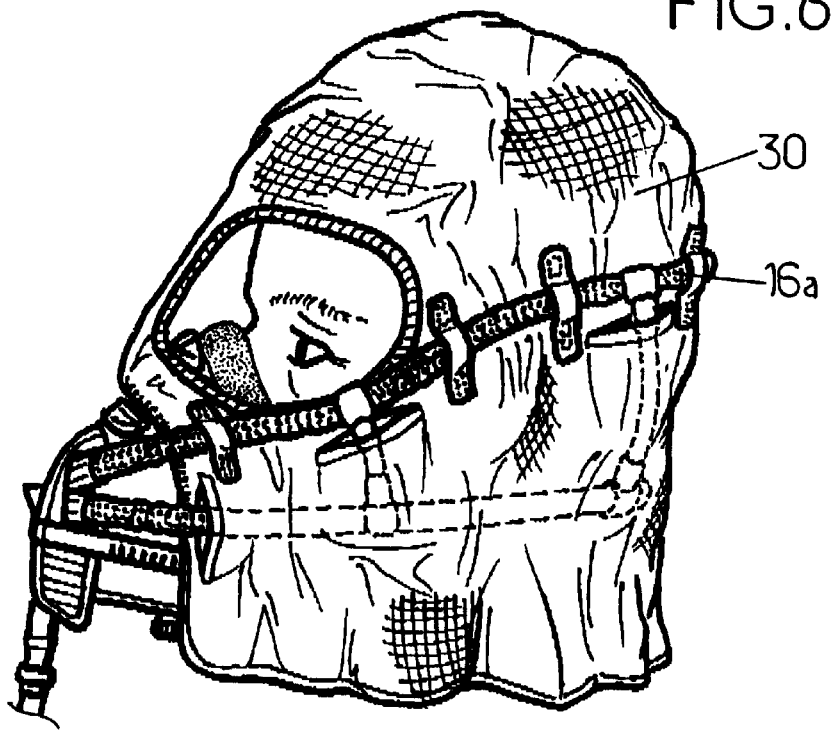

The variant embodiment shown in FIG. 6 differs from the preceding variant in that the cover is extended beneath the top strap 16*a* and passes over the bottom strap to which it may or may not be fixed. When the bottom strap lengthens to enable the equipment to be put into place on the head, that causes the bottom portion of the cover to be spread out, thereby making the equipment easier to put into place on the head.

Donning

When not in use, the mask is stowed in a folded state in a storage box, e.g. of the kind described in document U.S. Pat. No. 5,913,307, with the connection block projecting from the box. When the user desires to don the mask, the user takes hold of the connection block 12, pulls the equipment out from the box, and presses the lugs 18 together. The breathing gas inlet is then connected to the harness which lengthens until its initially-puckered outer sheaths become tensioned. The edge of the cover 30 spreads out following the lengthening of the harness. The user can then place the mask on the face and the cover over the head until it comes down onto the scalp.

Thereafter the user releases the lugs 18 so that the straps can exhaust. The mask 10 is then pressed against the face with maximum force. The edge of the cover or an intermediate portion thereof shrinks together with the straps 16*a*. The cover then puckers, particularly in the rear zone of the strap, and the puckering is pressed against the head by the strap tightening without that leading to any significant undesirable leakage effect.

Leaktightness is also improved when the cover extends beneath the top strap, or better still beneath both straps.

Removing the Mask

When the user desires to return the equipment into the box, the harness is fully inflated by acting on the lugs 18. The equipment can then be taken off. Once the mask has been removed, the user releases the lugs 18 so that the harness and the cover become flexible and can be folded by hand, after which the equipment can be stowed in its box.

Figure 7:
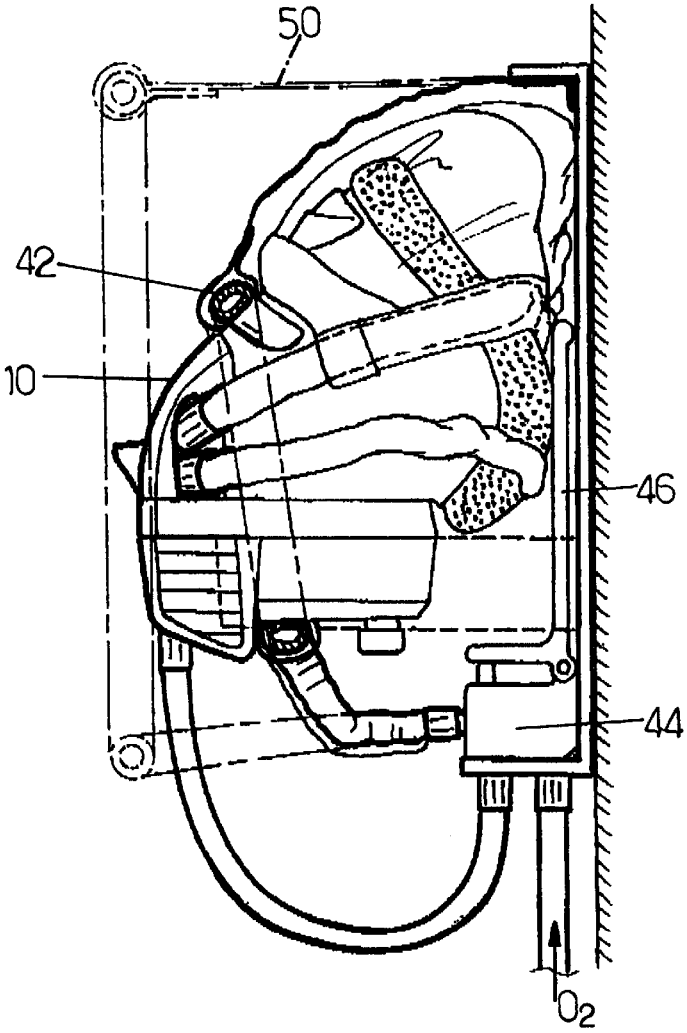
FIG. 7 is a diagram showing a storage bag in cross-section together with equipment in place in the bag, the annular element being deflated.

In the variant shown in FIG. 7, the storage device is a bag having a flexible wall 50 with an edge defining an opening through which the mask can pass, which opening is provided with an extensible annular element 42 whose elasticity tends to shrink it. Means enable compressed gas to be admitted into this element in order to lengthen it.

The structure of the annular element 42 can be similar to that of an inflatable harness strap, as described in the documents mentioned above. The annular element then generally comprises a tube of elastic material that is as leakproof as possible and on or in which there is placed a sheath that is flexible but substantially inextensible, such that the length of the sheath in the extended state defines the largest possible section for the opening.

The elasticity of the annular element 42 of such a device is advantageously such that when said element is deflated it presses against the nose of the mask 10, leaving a hole that is much smaller than that left by the flaps of a box.

The means for feeding the annular element 42 can be combined with those for feeding the harness. These feed means can comprise, for example, a three-port valve 44 which, at rest, connects the elements to the atmosphere and, when the mask is pulled to extract it from the bag, takes up a position in which it feeds compressed gas to the annular element. For this purpose, the valve can be controlled by an arm 46 placed against the rigid back wall of the bag 50 and causing the valve to take up its exhaust position when the mask presses thereagainst, or conversely, designed to have two elastic locking positions and to be pulled by the mask when the mask is taken from the bag.

The gas feed means can also comprise a valve which is forced into the feed position in response to manual action being taken on a button and which returns to its position for exhausting to the atmosphere after a determined length of time has elapsed.

What is claimed is:

1. Breathing protection equipment comprising:

a breathing mask carrying a regulator arranged for connection to a source of breathing gas under pressure, a harness having at least one extensible strap whose ends are connected to the mask and which includes an element which is temporarily inflatable by admitting at will said breathing gas under pressure in order to lengthen the strap to a size that is large enough to enable a user of the equipment to don the harness over the head of the user and which is deflatable so as to allow the strap to tighten, to press the mask against the face of the user and to hold the mask in place, and a sheath apt to limit an amount of extension of the strap and fixed to the mask, and a flexible cover for covering the head, having an air tight connection with the mask and an air tight connection with the sheath, said cover being transparent at least in a portion thereof that lies in front of the eyes of the user when the equipment is being worn.

2. Equipment according to claim 1, wherein a portion of the cover is fixed to the sheath and has a length that is sufficient for not opposing lengthening of the sheath to a value which would be insufficient for donning the equipment and said portion of the cover is designed to pucker when the strap is deflated.

3. Equipment according to claim 1, wherein the cover has a cap-shaped upper portion which extends upwards from the strap and a lower portion which extends downwards from the strap and is unrestrained.

4. Equipment according to claim 3, having a top strap constituting the firstly named strap and a bottom strap, wherein a tubular portion of the cover beneath the top strap is unrestrained by the bottom strap and passes either outside the bottom strap so that when the bottom strap inflates It spreads out the bottom portion thereof and facilitates donning of the equipment on the head, or inside the bottom strap, for increased protection.

5. Equipment according to claim 1, wherein the cover comprises a single piece of transparent material with a portion thereof constituting an eyeshield.

6. Equipment according to claim 5, wherein the eyeshield-forming portion is thicker and less flexible than a remaining part of the cover and is of uniform thickness.

7. Equipment according to claim 5, wherein the eyeshield-forming portion forms two separate eyepieces united by a thinner portion that is foldable to facilitate stowage.

8. Equipment according to claim 1, wherein the cover is of composite structure and has a non-transparent portion of fabric that is substantially impermeable and withstands high temperatures, and a transparent portion constituting a flexible eyeshield that is sealingly fixed to the fabric.

9. Equipment according to claim 1, wherein the cover is made of non flammable material.

10. Equipment according to claim 1, further including an aneroid capsule constituting an altitude detector and arranged for venting the straps or strap in order to ensure maximum tightness in the event of ambient depressurization.

11. Breathing protection equipment comprising:

a breathing mask carrying a, regulator arranged for connection to a source of breathing gas under pressure, a harness having an extendable top strap and an extendable bottom strap whose ends are connected to the mask and which each include an element which is temporarily inflatable by admitting at will said gas under pressure in order to lengthen the strap to a size that is large enough to enable a user of the equipment to don the harness over the head and which can be deflated so as to allow the strap to tighten, to press the mask against the face, and to hold it in place, and a flexible cover for covering the head, fixed in leak-tight manner to a sheath apt to limit elongation of at least the top strap of the harness, and fixed to the mask, said cover being transparent at least in a portion thereof that lies in front of the eyes of the user when the equipment is being worn.

12. Breathing protection equipment comprising:

a breathing mask carrying a regulator arranged for connection to a source of breathing gas under pressure, a harness having at least one extensible strap whose ends are connected to the mask and which includes an element which is temporarily inflatable by admitting at will said breathing gas under pressure in order to lengthen the strap to a size that is large enough to enable a user of the equipment to don the harness over the head of the user and which is deflatable so as to allow the strap to tighten, to press the mask against the face of the user and to hold the mask in place, and an inextensible non rigid outer sheath arranged to limit extension of the strap to predetermined length and fixed to the mask, and a flexible cover for covering the head, having an air tight connection with the mask and with said outer sheath, said cover being transparent at least in a portion thereof that lies in front of the eyes of the user when the equipment is being worn.

13. Breathing protection equipment comprising:

a breathing mask carrying a regulator arranged for connection to a source of breathing gas under pressure, a harness having at least one extensible strap whose ends are connected to the mask and which includes an element which is temporarily inflatable by admitting at will said breathing gas under pressure in order to lengthen the strap to a size that is large enough to enable a user of the equipment to don the harness over the head of the user and which is deflatable so as to allow the strap to tighten, to press the mask against the face of the user and to hold the mask in place, and a sheath apt to limit an amount of extension of the strap and fixed to the mask, and a flexible cap-shaped cover for covering the head, having an air tight connection with the mask and having an air tight connection with and along the sheath in an edge portion of said cover, said cover being transparent at least in a portion thereof that lies in front of the eyes of the user when the equipment is being worn.

* * * * *